US008973323B1

(12) United States Patent
McDonald

(10) Patent No.: US 8,973,323 B1
(45) Date of Patent: Mar. 10, 2015

(54) REBAR CAP

(71) Applicant: Curt McDonald, Englewood, FL (US)

(72) Inventor: Curt McDonald, Englewood, FL (US)

( * ) Notice: Subject to any disclaimer, the term of this patent is extended or adjusted under 35 U.S.C. 154(b) by 0 days.

(21) Appl. No.: 14/089,846

(22) Filed: Nov. 26, 2013

Related U.S. Application Data

(60) Provisional application No. 61/875,848, filed on Sep. 10, 2013.

(51) Int. Cl.
*E04H 12/00* (2006.01)
*E04C 5/16* (2006.01)

(52) U.S. Cl.
CPC ..... *E04C 5/161* (2013.01)
USPC ..... 52/301

(58) Field of Classification Search
CPC ... E04C 5/161; E04H 2017/006; E04G 21/32; E04G 21/3252; E04G 21/3204
USPC ..... 52/301, 300, 287.1, 244, 677, 679, 687; D10/70, 74; D8/354, 349; D25/135
See application file for complete search history.

(56) References Cited

U.S. PATENT DOCUMENTS

| | | | | |
|---|---|---|---|---|
| 4,202,378 | A | 5/1980 | Bush et al. | |
| 5,381,636 | A | 1/1995 | Kassardjian et al. | |
| 5,568,708 | A | 10/1996 | Kassardjian et al. | |
| 5,729,941 | A | 3/1998 | Kassardjian et al. | |
| D405,349 | S | 2/1999 | Orth | |
| D408,268 | S | 4/1999 | Dunn | |
| 5,946,871 | A | 9/1999 | Kassardjian et al. | |
| 6,085,478 | A | 7/2000 | Workman | |
| 6,612,082 | B2 * | 9/2003 | Schimmelpfennig et al. | 52/300 |
| 6,857,235 | B2 * | 2/2005 | Niday et al. | 52/301 |
| 7,472,522 | B2 | 1/2009 | Yang | |
| 7,716,898 | B1 | 5/2010 | Dunn | |
| D654,384 | S * | 2/2012 | McDonald | D10/66 |
| 8,141,309 | B2 * | 3/2012 | Kubicek | 52/301 |
| 2008/0168726 | A1 * | 7/2008 | Yang | 52/301 |
| 2009/0107067 | A1 * | 4/2009 | Beery | 52/301 |
| 2009/0313927 | A1 | 12/2009 | Myers, Jr. et al. | |
| 2012/0291381 | A1 | 11/2012 | Kassardjian et al. | |

* cited by examiner

*Primary Examiner* — Jessica Laux
(74) *Attorney, Agent, or Firm* — Dickinson Wright PLLC

(57) ABSTRACT

A rebar cap assembly, for use in connection with a rebar rod with a free end includes a metal casing and a circular metal disc independent of the casing. The casing has a side wall with a cylindrical shape extending between an open end and a closed end with a top wall for receiving the free end of the rebar rod. A shoulder extends annularly about and radially from the side wall into the closed end. The side wall has an outer surface with a plurality of retaining tabs to secure the rebar cap to the rebar rod. The disc extends to a circular perimeter in a cantilevered fashion radially outwardly from the closed end of the casing. A bond is sandwiched between the top wall of the casing and the disc for securing to the disc to the casing.

15 Claims, 3 Drawing Sheets

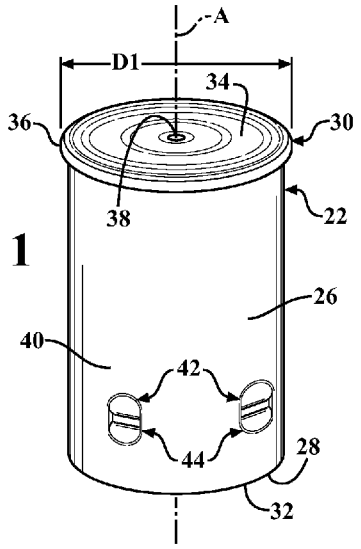
FIG. 1
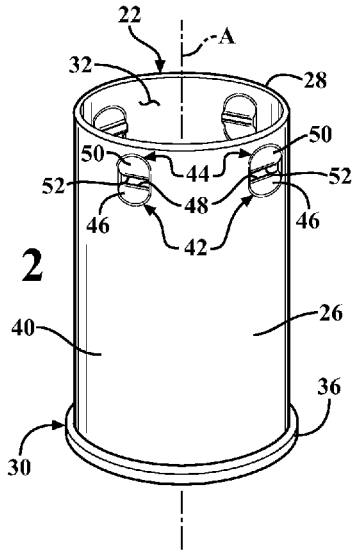
FIG. 2
FIG. 3
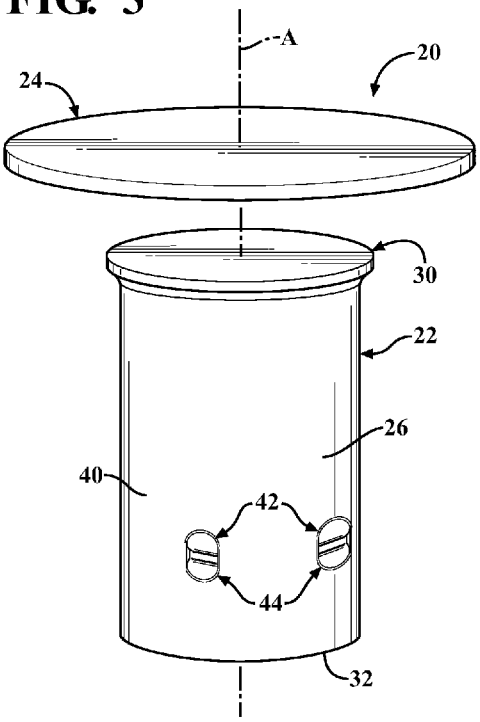
FIG. 4
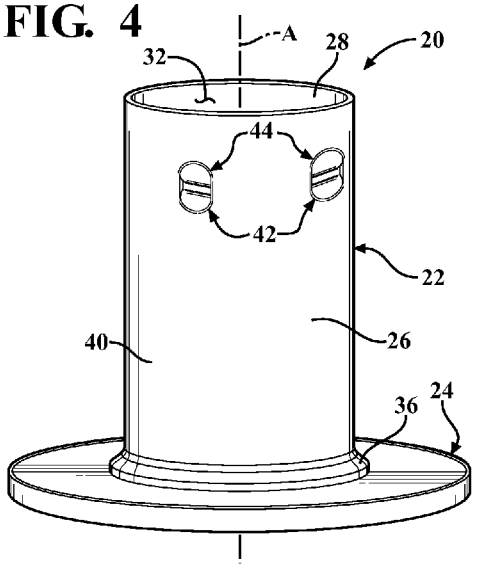

REBAR CAP

CROSS REFERENCE TO RELATED APPLICATION

This application claims the benefit of application Ser. No. 61/875,848 filed Sep. 10, 2013.

BACKGROUND OF THE INVENTION

1. Field of the Invention

A rebar cap assembly for covering the free end of a rebar rod.

2. Description of the Prior Art

Rebar cap assemblies for covering the free end of a rebar rod are generally known in the art. One such assembly is disclosed in U.S. Design Pat. D654,384 granted Feb. 21, 2012 to Curt McDonald (hereinafter, the '384 patent), which discloses a rebar cap with a casing of a continuous integral metal material with a cylindrical side wall disposed about an axis and extending between an open end and a closed end with a top wall to define an interior space between the open end and the closed end for receiving the free end of the rebar rod. The rebar cap disclosed in the '384 patent also includes a shoulder extending annularly about and radially from the side wall and extending into the top wall. The rebar cap of the '384 patent further includes retaining tabs in the side wall for securing the rebar cap to the free end of the rebar rod, with the retaining tabs spaced axially from the open end and spaced circumferentially at regular intervals, and including a ramp extending into the interior space toward the closed end and terminating at a lip.

SUMMARY OF THE INVENTION

The invention provides for such a rebar cap assembly including a disc of a continuous integral metal material defining a layer independent of the top wall of the casing and disposed upon the axis and extending in an unsupported cantilevered fashion to a perimeter spaced a distance radially outwardly from the first diameter of the closed end of the casing.

Advantages of the Invention

The invention in its broadest aspect provides for a rebar cap that includes both a continuous integral metal casing and a continuous integral metal disc, which may be manufactured independently. The combination of the metal casing and metal disc allows the rebar cap of the subject invention to be inexpensively manufactured when compared with other rebar caps, such as those of cast metal. The separately manufactured casing and disc also allows them to be constructed of different materials and/or materials having different properties, such as thickness or treatment. This construction allows each of the casing and the disc to be independently optimized for desirable characteristics, such as strength against bending or the ability to be drawn to a formed shape.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 1 is a perspective view of the closed end of the casing of the subject invention.

FIG. 2 is a perspective view of the open end of the casing of the subject invention.

FIG. 3 is an exploded perspective view of a rebar cap assembly with a flat disc, shown separated from the casing.

FIG. 4 is a perspective view of a rebar cap assembly having a flat disc, showing the open end of the casing.

DESCRIPTION OF THE ENABLING EMBODIMENT

Figure 5:
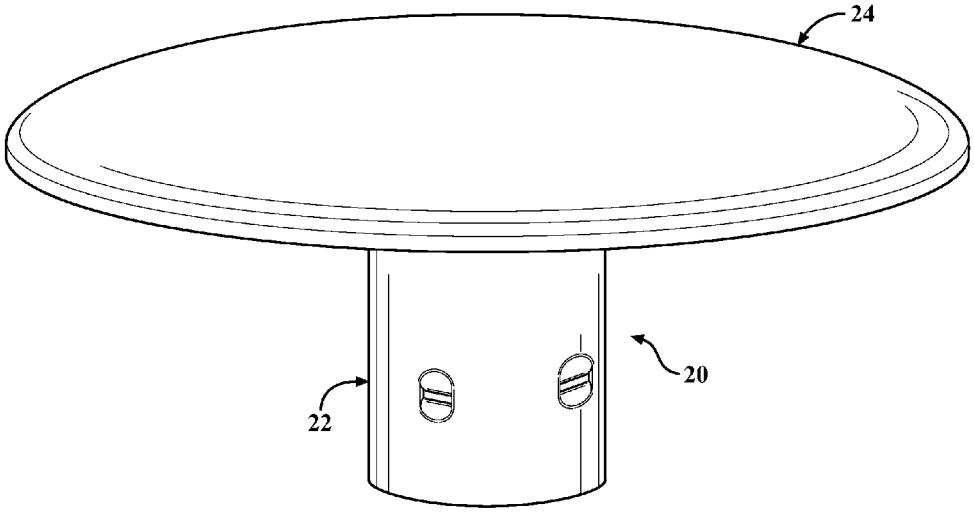
FIG. 5 is a perspective view of a rebar cap assembly showing a disc with a dome shape covering the casing.

Referring to the Figures, wherein like numerals indicate corresponding parts throughout the several views, a rebar cap assembly 20, for use in connection with a rebar rod with a free end, is generally shown in FIGS. 3-8. The rebar cap includes a metal casing 22 and a metal disc 24 with a surface area larger than the free end of the rebar rod alone. There are many possible uses for the rebar cap assembly 20. The rebar cap assembly 20 may be used as a marker, such as for surveying land, with the disc providing increased visibility and providing a surface for identifying text or other symbols. The rebar cap assembly 20 may also be used as a safety cap to protect against potential hazards from an exposed free end of a rebar rod such as impalement. It should be appreciated that the above uses are merely examples and are not intended to be limiting.

The rebar cap assembly 20 includes a casing 22 of continuous integral metal material generally indicated in FIGS. 1-8. The casing 22 has a side wall 26 with a cylindrical shape disposed about an axis A to define an interior space 32 extending between the open end 28 and the closed end 30 for receiving the free end of the rebar rod. The closed end 30 includes a top wall 34 having a first diameter D1. The side wall 26 of the casing 22 features a shoulder 36 extending annularly about and radially from the side wall 26 and extending into the closed end 30. As a result of the process of forming the casing 22, the top wall 34 may include a circular depression 38 centered upon the top wall 34.

The side wall 26 has an outer surface 40 with a plurality of retaining tabs 42, 44 spaced axially from the open end 28. The retaining tabs 42, 44 are also spaced circumferentially at regular intervals and extending toward the axis A for engaging the free end of the rebar rod to secure the rebar cap to the rebar rod. In other words, when the free end of the rebar rod is disposed in the interior space 32 of the casing 22, the rebar rod is secured in the casing 22 by the retaining tabs 42, 44. The retaining tabs 42, 44 include a first retaining tab 42 with a first ramp 46 extending inwardly toward the open end 28 and terminating at a first lip 48. The retaining tabs 42, 44 also include a second retaining tab 44 with a second ramp 50 extending inwardly toward the closed end 30 and terminating at a second lip 52. The retaining tabs 42, 44 may be integral, with the first lip 48 and the second lip 52 connected together. Alternately, the retaining tabs 42, 44 may be independent, with the first lip 48 separated from the second lip 52.

The rebar cap assembly 20 also includes a disc 24 of continuous integral metal material, generally indicated in FIGS. 3-8. The disc 24 has a circular perimeter 54 defining a layer that is independent of the top wall 34 of the casing 22. The disc 24 is disposed upon the axis A and extends in an unsupported cantilevered fashion to the perimeter 54 spaced a distance radially outwardly from the first diameter D1 of the closed end 30 of the casing 22. The disc 24, having a relatively larger diameter than the casing 22, functions to distribute the weight of a person falling upon the free end of the rebar rod for protection against impalement. The relatively large diameter of the disc 24 also increases the visibility of the cap and provides a surface for identifying text or other symbols.

The combination of the metal casing 22 and the metal disc 24 allows the rebar cap 20 to be left on a rebar rod when concrete is poured around the rebar rod and rebar cap 20. Rebar caps made of non-metals such as plastic must be removed before concrete is poured to prevent the hardened concrete from being weakened by their presence.

A bond 56 is sandwiched between the top wall 34 of the casing 22 and the layer of the disc 24 for securing to the disc 24 to the casing 22. The bond 56 may be formed of a resistance weld or any other suitable connecting means.

FIGS. 3-4 show an embodiment of the rebar cap assembly 20 wherein the disc 24 is flat.

Figure 6:
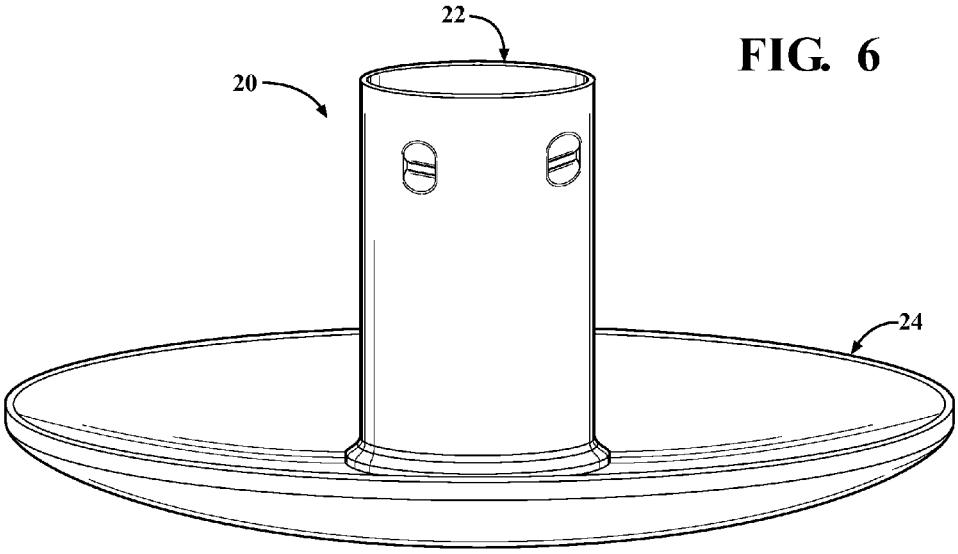
FIG. 6 is a perspective view, showing the open end of the casing of a rebar cap assembly having a disc with a dome shape.

FIGS. 5-6 show an alternate embodiment of the rebar cap assembly 20 wherein the disc 24 is dome shaped.

Figure 7:
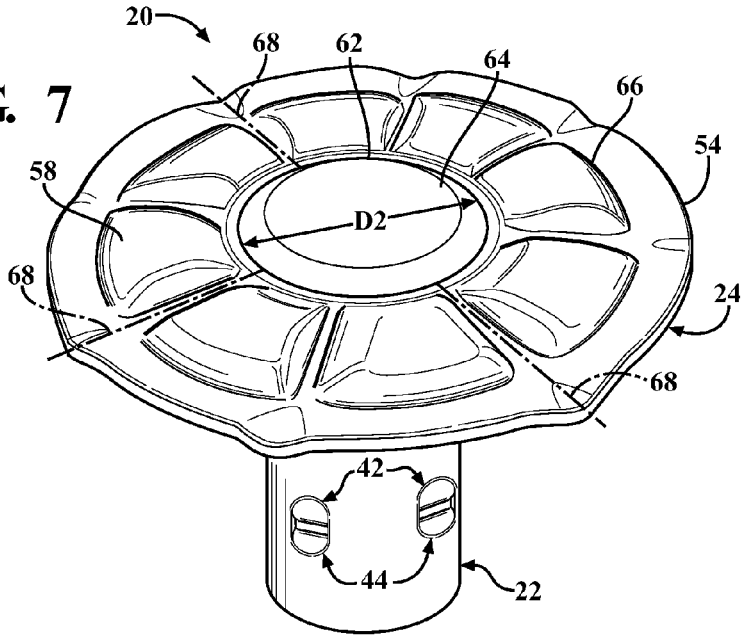
FIG. 7 is a perspective view of a rebar cap assembly showing a disc with corrugations covering the casing.
Figure 8:
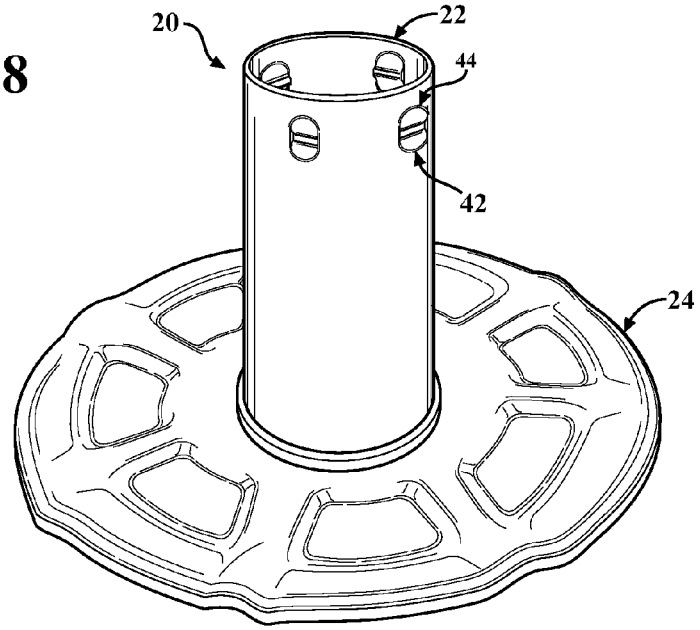
FIG. 8 is a perspective view, showing the open end of the casing of a rebar cap assembly having a disc with corrugations.

FIGS. 7-8 show an alternate embodiment of the rebar cap assembly 20 wherein the disc 24 has a face side 58 opposite the closed end 30 including a plurality of corrugations 60 for strengthening the disc 24.

The corrugations 60 include a first annular indentation 62 defining a second diameter D2 which is longer than the first diameter D1 of the top wall 34 to define a flat central region 64 of the disc 24 for receiving the top wall 34 of the casing 22. A second annular indentation 66 is disposed concentrically about the first annular indentation 62. The corrugations 60 also include a plurality of troughs 68 that extend radially outwardly from the first annular indentation 62 to the perimeter 54.

Obviously, many modifications and variations of the present invention are possible in light of the above teachings and may be practiced otherwise than as specifically described while within the scope of the appended claims. That which is prior art in the claims precedes the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

| Element Symbol | Element Name |
|---|---|
| A | axis |
| 20 | assembly |
| 22 | casing |
| 24 | disc |
| 26 | side wall |
| 28 | open end |
| 30 | closed end |
| 32 | interior space |
| 34 | top wall |

-continued

| Element Symbol | Element Name |
|---|---|
| 36 | shoulder |
| 38 | circular depression |
| 40 | outer surface |
| 42 | first retaining tab |
| 44 | second retaining tab |
| 46 | first ramp |
| 48 | first lip |
| 50 | second ramp |
| 52 | second lip |
| 54 | perimeter |
| 56 | bond |
| 58 | face side |
| 60 | corrugations |
| 62 | first annular indentation |
| 64 | flat central region |
| 66 | second annular indentation |
| 68 | troughs |
| D1 | first diameter |
| D2 | second diameter |

What is claimed is:

1. A rebar cap assembly (20) for use in connection with a rebar rod extending to a free end, said assembly (20) comprising;

a casing (22) of a first continuous integral metal material including a side wall (26) of cylindrical shape disposed about an axis (A) and extending between an open end (28) and a closed end (30) defined by a top wall (34) to define an interior space (32) between said open end (28) and said closed end (30) for receiving the free end of the rebar rod, a shoulder (36) extending annularly about and radially outwardly from said side wall (26) at said closed end (30) to terminate at and define a first diameter (D1), said top wall (34) presenting a flat surface in a plane extending to and terminating at said first diameter (D1) whereby said casing (22) terminates at said first diameter (D1), and characterized by a disc (24) of a second continuous integral metal material having a perimeter (54) defining a layer independent of said top wall (34) of said casing (22) and disposed in contact with said shoulder (36) upon said axis (A) and extending radially outward into space immediately from said first diameter (D1) of said shoulder (36) in an unsupported cantilevered fashion to said perimeter (54) spaced a distance radially outwardly from said first diameter (D1) of said shoulder (36) whereby said disc (24) is free of contact and support radially between said first diameter (D1) of said shoulder (36) and said perimeter (54) so that all axial force upon said disc (24) is transmitted to said casing (22) within said first diameter (D1).

2. An assembly (20) as set forth in claim 1 further including a bond (56) sandwiched between said top wall (34) of said casing (22) and said layer of said disc (24) for securing said disc (24) to said casing (22).

3. An assembly (20) as set forth in claim 1 further including said side wall (26) having an outer surface (40) presenting a plurality of retaining tabs (42, 44) spaced axially from said open end (28) and spaced circumferentially at regular intervals and extending into said interior space (32) for securing the rebar cap to the free end of the rebar rod.

4. An assembly (20) as set forth in claim 3 further including said retaining tabs (42, 44) including a first retaining tab (42)

with a first ramp (46) extending inwardly toward said open end (28) and terminating at a first lip (48).

5. An assembly (20) as set forth in claim 3 further including said retaining tabs (42, 44) including a second retaining tab (44) with a second ramp (50) extending inwardly toward said closed end (30) and terminating at a second lip (52).

6. The rebar cap assembly (20) as set forth in claim 1 wherein said top wall (34) presents a circular depression (38) centered upon said axis (A).

7. The rebar cap assembly (20) as set forth in claim 1 wherein said disc (24) is flat.

8. The rebar cap assembly (20) as set forth in claim 1 wherein said disc (24) is dome shaped.

9. The rebar cap assembly (20) as set forth in claim 1 wherein said disc (24) includes a face side (58) opposite said closed end (30) and said face side (58) presenting a plurality of corrugations (60) for strengthening said disc (24).

10. The rebar cap assembly (20) as set forth in claim 9 wherein said corrugations (60) include a first annular indentation (62) defining a second diameter (D2) and a second annular indentation (66) disposed concentrically about said first annular indentation (62) with said second diameter (D2) of said first annular indentation (62) being longer than said first diameter (D1) of said top wall (34) and defining a flat central region (64) of said disc (24) for receiving said top wall (34).

11. The rebar cap assembly (20) as set forth in claim 10 wherein said corrugations (60) include a plurality of troughs (68) extending radially outwardly from said first annular indentation (62) and continuing to said perimeter (54).

12. A rebar cap assembly (20) for use in connection with a rebar rod extending to a free end, said assembly (20) comprising;

a casing (22) of a first continuous integral metal material including a side wall (26) of cylindrical shape disposed about an axis (A) and extending between an open end (28) and a closed end (30) defined by a top wall (34) to define an interior space (32) between said open end (28) and said closed end (30) for receiving the free end of the rebar rod, a shoulder (36) extending annularly about and radially outwardly from said side wall (26) at said closed end (30) to terminate at and define a first diameter (D1), said top wall (34) presenting a flat surface in a plane extending to and terminating at said first diameter (D1) whereby said casing (22) terminates at said first diameter (D1), said top wall (34) presenting a circular depression (38) in said flat surface and centered upon said axis (A), said side wall (26) having an outer surface (40) presenting a plurality of retaining tabs (42, 44) spaced axially from said open end (28) and spaced circumferentially at regular intervals and extending into said interior space (32) for securing the rebar cap to the free end of the rebar rod, said retaining tabs (42, 44) including a first retaining tab (42) with a first ramp (46) extending inwardly toward said open end (28) and terminating at a first lip (48), said retaining tabs (42, 44) including a second retaining tab (44) with a second ramp (50) extending inwardly toward said closed end (30) and terminating at a second lip (52), and characterized by a disc (24) of a second continuous integral metal material having a circular perimeter (54) defining a layer independent of said top wall (34) of said casing (22) and disposed in contact with said shoulder (36) upon said axis (A) and extending radially outward into space immediately from said first diameter (D1) and in or below said plane of said top wall (34) and said shoulder (36) in an unsupported cantilevered fashion to said perimeter (54) spaced a distance radially outwardly from said first diameter (D1) of said shoulder (36) whereby said disc (24) is free of contact and support radially between said first diameter (D1) of said shoulder (36) and said perimeter (54) so that all axial force upon said disc (24) is transmitted to said casing (22) within said first diameter (D1), a bond (56) sandwiched between said top wall (34) of said casing (22) and said layer of said disc (24) for securing said disc (24) to said casing (22).

13. The rebar cap assembly (20) as set forth in claim 12 wherein said disc (24) is flat.

14. The rebar cap assembly (20) as set forth in claim 12 wherein said disc (24) is dome shaped.

15. The rebar cap assembly (20) as set forth in claim 12 wherein said disc (24) includes a face side (58) opposite said closed end (30) and said face side (58) presenting a plurality of corrugations (60) for strengthening said disc (24), said corrugations (60) including a first annular indentation (62) defining a second diameter (D2) and a second annular indentation (66) disposed concentrically about said first annular indentation (62) with said second diameter (D2) of said first annular indentation (62) being longer than said first diameter (D1) of said top wall (34) and defining a flat central region (64) of said disc (24) for receiving said top wall (34), said corrugations (60) including a plurality of troughs (68) extending radially outwardly from said first annular indentation (62) and continuing beyond said second annular indentation (66) to said perimeter (54).

* * * * *